United States Patent [19]

Zeller

[11] Patent Number: 4,505,321

[45] Date of Patent: Mar. 19, 1985

[54] METHOD OF, AND APPARATUS FOR, COOLING AND SUPPORTING A STRAND IN A PLATE MOLD OF A CONTINUOUS CASTING INSTALLATION, ESPECIALLY FOR CASTING STEEL STRANDS

[75] Inventor: Josef Zeller, Weesen, Switzerland

[73] Assignee: Concast Service Union AG, Zurich, Switzerland

[21] Appl. No.: 461,472

[22] Filed: Jan. 27, 1983

[30] Foreign Application Priority Data

Feb. 12, 1982 [CH] Switzerland ..... 879/82

[51] Int. Cl.[3] ..... B22D 11/04

[52] U.S. Cl. ..... 164/491; 164/436

[58] Field of Search ..... 164/491, 436, 435, 452, 164/154

[56] References Cited

U.S. PATENT DOCUMENTS

| | | | |
|---|---|---|---|
| 3,662,814 | 5/1972 | Kipp et al. | 164/436 X |
| 3,926,244 | 12/1975 | Meier et al. | 164/491 X |
| 3,978,909 | 9/1976 | Schöffmann | 164/436 |
| 4,030,536 | 6/1977 | Rodenchuk et al. | 164/435 X |
| 4,069,863 | 1/1978 | Hargassner et al. | 164/436 |
| 4,245,692 | 1/1981 | Hargassner et al. | 164/436 |
| 4,300,620 | 11/1981 | Wolf | 164/452 |
| 4,304,290 | 12/1981 | Wolf | 164/491 X |
| 4,356,862 | 11/1982 | Gloor | 164/491 |

FOREIGN PATENT DOCUMENTS

| | | | |
|---|---|---|---|
| 28227 | 3/1979 | Japan | 164/436 |

*Primary Examiner*—Nicholas P. Godici
*Assistant Examiner*—Gerard M. Reid
*Attorney, Agent, or Firm*—Werner W. Kleeman

[57] ABSTRACT

During a change in casting parameters, particularly during displacement of a mold wall to change the strand format or cross-sectional shape, the supporting action and the cooling capacity should not fall either below a well-defined supporting action and a predetermined cooling capacity in order to avoid metal break-out or other defects in the cast strand. Furthermore, upon changing the strand cross-section the rate of adjustment should be increased in order to reduce the length of transitional pieces between the old strand format and the new strand format. To achieve this result it is contemplated to bend the mold wall, during displacement thereof into each pivotal position thereof, this bending of the mold wall corresponding to the instantaneous geometric shape of the moving solidified shell or skin of the strand and such bending is represented by bending lines.

15 Claims, 3 Drawing Figures

FIG. 1
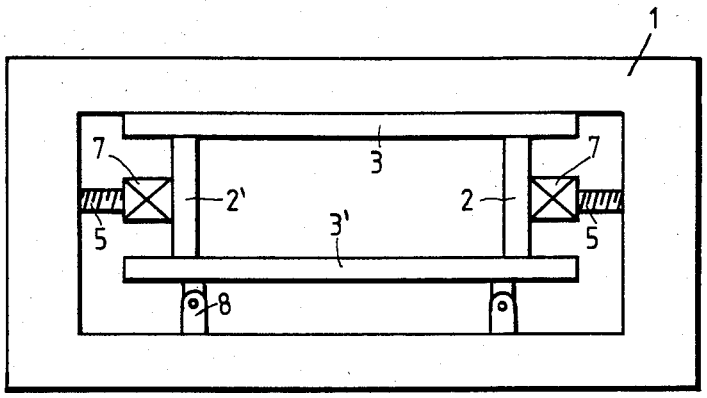
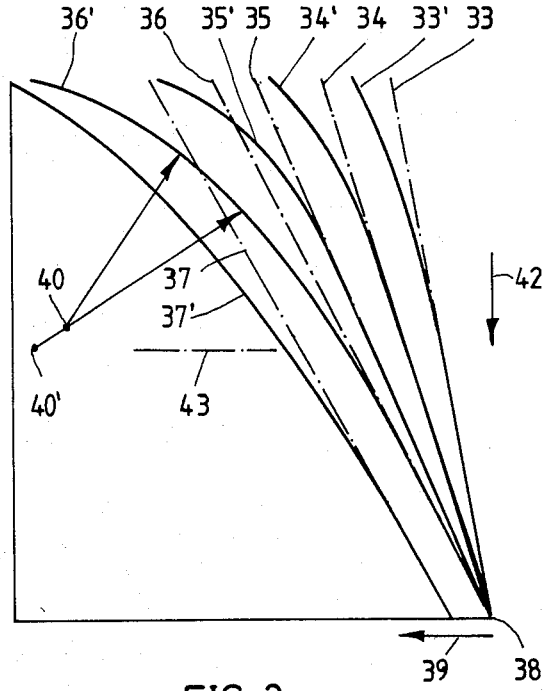
FIG. 3

METHOD OF, AND APPARATUS FOR, COOLING AND SUPPORTING A STRAND IN A PLATE MOLD OF A CONTINUOUS CASTING INSTALLATION, ESPECIALLY FOR CASTING STEEL STRANDS

BACKGROUND OF THE INVENTION

The present invention relates to an improved method of, and apparatus for, cooling and supporting a strand in a plate mold of a continuous casting installation, especially for casting steel strands, during a change in casting parameters, in particular during displacement of a mold wall arranged between wide side walls of the mold for changing the strand cross-section or format.

It is known in strand casting installations, particularly in steel strand casting installations, to use plate molds having a hollow mold compartment of adjustable width. In such plate molds the narrow side walls are arranged between the wide side walls and are displaceable transversely with respect to the strand travel or running direction by means of suitable displacement devices, such as spindles and so forth.

Recently, it has furthermore become known to change the strand format also during a running casting operation. Here, the displacement devices are operated by remote control.

In a state-of-the-art format adjusting method as known, for example from U.S. Pat. No. 4,356,862, granted Nov. 2, 1982 and as used in steel strand casting installations, brief adjusting times and short transitional pieces in the cast strand are achieved by providing two displacement devices disposed in tandem at one narrow side of the mold with respect to the strand travel or running direction. The displacement devices are operated in such a manner that during the pivoting displacement of the mold wall there is altered the mutual ratio of the rates of displacement of the two displacement devices. With this method the formation of a gap intermediate the mold wall and the solidified shell or skin of the strand is reduced. By using this method the deformation of the solidified strand shell also can be maintained within narrow limits if there is not selected a too high rate of displacement or pivoting rate of the mold wall, respectively. Although small air gaps are partially compensated by local bulging at the central range or region of the narrow side of the mold, the cooling capacity decreases at the edge regions, whereby the danger of metal break-outs is increased and the operational reliability of the equipment is reduced. To prevent such metal break-outs, according to this adjusting method there can be hardly avoided relatively long transitional pieces between two different formats of the cast strand of, for example, 2.5 meters for a change of 50 mm in width.

SUMMARY OF THE INVENTION

Therefore, with the foregoing in mind it is a primary object of the present invention to provide an improved method of, and apparatus for, cooling and supporting a cast strand in a plate mold of a continuous casting installation, especially for casting steel strands, which enables optimum cooling and support of the solidified shell or skin of the cast strand during a change in a casting parameter, particularly upon changing the position of mold walls.

Another important object of the present invention aims at the provision of a new and improved method and apparatus of the aforementioned type which, during the running casting operation, reliably achieves high rates of mold wall adjustment.

Still a further significant object of the present invention is directed to a new and improved method of and apparatus for cooling and supporting a strand in a plate mold of a steel strand casting installation which achieves high operating reliability.

Now in order to implement these and still further objects of the invention, which will become more readily apparent as the description proceeds, the method of the present development is manifested by the features that, during displacement of the mold wall a bend or bending action is applied thereto which essentially corresponds to the instantaneous geometric shape of the moving solidified strand shell or skin associated with such mold wall.

On the other hand, the apparatus of the present development is manifested by the features that, bending means are operatively associated with at least one mold wall, in order to bend the same along predetermined bending lines which define circles of curvature, the central axes of which extend transversely with respect to the strand travel or running direction and substantially parallel to the mold wall. There are also provided control means for controlling the bending means.

By using the method and apparatus according to the invention, optimum cooling and support of the strand and, specifically, the still thin solidified shell or layer of such strand is achieved at low friction during a change in the position of the mold wall. This results in rapid heat removal with uniform growth of the solidified strand shell and in a faultless strand surface. Due to the high possible rate of adjustment, the length of conical transitional or transition pieces in the strand is reduced, while at the same time there are possible larger adjustment steps in width. The optimum cooling and support of the still thin solidified layer of the strand, furthermore, very substantially reduces the danger of metal break-out, and thus, additionally results in an indirect increase in the output during the casting of different strand formats or sectional shapes without interruption in the casting process. Also, wear at the mold walls can be reduced.

When the strand width is changed after a preceding pivotal movement, generally the pivoted mold wall is parallely displaced. To achieve high rates of adjustment of the displaceable mold wall, it is of advantage if a displacing movement is additionally superimposed upon the pivotal movement and the bending of the mold wall.

Depending upon the rate of pivoting and the rate of movement, respectively, of the solidified shell or skin of the strand, the instantaneous geometric shape of the moving solidified shell or skin of the strand can be predetermined by using a programmable computer. Such predetermined and stored values are advantageously used to control the bending of the mold wall. As an alternative to this computation method, the bending and the rate of displacement, however, also may be adjusted in dependence upon a sequence of measurements of the thermal output of the mold wall taken in the strand travel or running direction.

During the calculation of the geometric shape of the solidified shell or layer of the strand any bulging can be neglected. According to a further feature of the invention, a gap-free support of the solidified shell or layer of the strand can be achieved if the central axes of the circles of curvature of the bent mold wall extend transversely with respect to the strand travel direction and parallel with respect to the mold wall.

Frequently, it will be sufficient at the start and at the end of the bending operation if the mold wall is only bent over part of its length, whereby the mold wall is bent on one side of the central axis extending transversely with respect to the strand travel or running direction and is placed at an inclination with respect to the strand travel direction on the other side of the central axis.

The design of the bendable mold wall can be realized by applying various constructional principles and by using various bendable materials. An advantageous construction will result if the mold wall comprises a flexible or bendable wall and a rigid support plate, and if the bending means or bending device comprises independently operable displacement devices connected to the support plate and arranged on both sides of a support shaft or pin. Advantageously the flexible or bendable wall is composed of a copper plate and a flexible, non-metallic compound plate provided with cooling channels or passages.

Furthermore, it is recommended according to the invention that the support shaft or pin forms a joint or hinge structure between the flexible wall and the rigid support plate.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a top plan view of a schematically illustrated plate mold according to the invention;

FIG. 3 shows bending lines of the narrow side wall shown in FIG. 2 during pivoting and displacement movement thereof.

DESCRIPTION OF THE PREFERRED EMBODIMENTS

Figure 2:
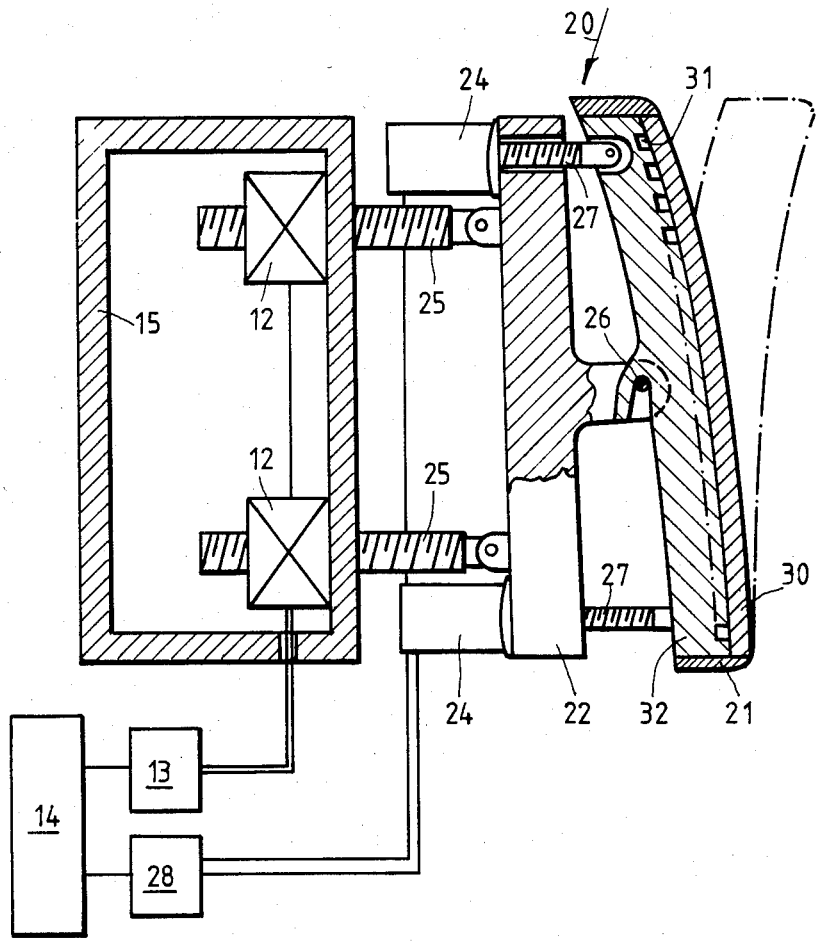
FIG. 2 is a vertical section through a narrow side wall of the plate mold shown in FIG. 1.

Describing now the drawings, it is to be understood that in order to simplify the illustration only enough of the construction of the continuous casting apparatus has been shown as needed for those skilled in the art to readily understand the underlying principles and concepts of the present invention. Turning now specifically to FIG. 1 of the drawings, there has been schematically illustrated therein an exemplary embodiment of a plate mold constructed according to the invention comprising a frame 1 at which two narrow side walls 2, 2' and two wide side walls 3, 3' are mounted. The narrow side walls 2, 2' are provided with suitable displacement devices, here shown in the form of spindles 5 for adjusting the strand cross-section or format and with schematically illustrated bending devices 7 for bending the narrow side walls 2, 2'. Conventional power devices are used to clamp the narrow side walls 2, 2' between the wide side walls 3, 3' via rods 8 linked thereto.

FIG. 2 shows details of a mold wall 20 which can be used, for example, as a narrow side wall in the plate mold shown in FIG. 1. This mold wall 20 is composed of a flexible or bendable wall 21 and a rigid support plate 22. Suitable bending devices 24 are pivotably arranged on both sides of a support shaft or pin 26 at the rigid support plate 22; they are appropriately linked to the flexible or bendable wall 21. The two bending devices 24 may comprise independently operable stepping motors for suitably moving the bending spindles 27. By using the stepping motors very precise axial movements of the bending spindles 27 are achievable by means of a conventional control device 28 which is connected to a programmable computer 14.

In the case of this mold wall 20 the support shaft or pin 26 forms a hinge connection or pivot between the flexible or bendable wall 21 and the rigid support plate 22.

The flexible or bendable wall 21 of the mold wall 20 is, for instance, composed of a copper plate 30 and a flexible or bendable compound plate 32 provided with cooling channels or passages 31. To decrease the bending force, the flexible wall 21 may be made of a non-metallic material like, for example, plastics, hard rubber or the like.

Depending upon the nature of the pivotal movement the flexible or bendable wall 21 may be bent to possess a convex or concave shape, the latter being shown in dash-dot or phantom lines.

To pivot and/or displace the mold wall 20, in this exemplary embodiment displacement devices 25, such as constituted by spindles and drive means 12 coacting with spindle nuts are provided in a mold frame 15. By means of control devices 13 the drive means 12 are also electrically connected to the computer 14. Bending, pivoting and parallel displacement movements of the mold wall 20 can occur in any mutual coordination.

The method for cooling and supporting a strand and the solidified shell or layer of the strand in a plate mold during displacement of a mold wall to change the strand cross-section or format will now be explained with reference to FIG. 3. During tilting of a mold wall a slightly curved solidified shell or skin will result on the strand in correspondence to the rate of tilting and the strand withdrawal speed, as has been shown by computer analysis. At a constant strand withdrawal speed the curvature of the solidified shell of the strand at the narrow side thereof will temporarily increase with increasing tilt or pivot angle. Reference numerals 33, 34, 35 and 36 indicate four different pivot positions of a mold wall about a pivot point 38. For simplicity, the pivot point 38 has been selected to be in a stationary position. Calculated bending lines, which are shown with an enlarged bending for enhanced clarity in FIG. 3 have been designated by reference characters 33', 34', 35' and 36'; each such bending line 33' to 36' corresponds to an associated pivot position 33 to 36, respectively. Corresponding to the instantaneous geometric shape of the solidified shell or layer of the strand the pivoting movement of the mold wall associated with this solidified shell or layer of the strand has superimposed thereon a bending action or force, in other words is bent corresponding to the bending lines 33' to 36'. Corresponding to the dash-dotted pivot positions 33 to 36 the pivoting movement is represented by four fractional steps. During the pivoting movement the bending changes either in small steps or, advantageously, continuously.

In addition to the pivoting movement and the bending there can be superimposed a displacement movement in the direction of the arrow 39, as indicated by the wall position 37. During such displacement the bending is generally reduced to zero in correspondence with the calculated curvature of the solidified shell or layer of the strand.

Axes 40, 40', representing the geometric center of the circles of curvature (not drawn to scale) from which the bending curve of the bent mold wall is composed, extend transversely with respect to the strand travel or running direction 42 and essentially parallely with respect to the mold wall.

As will be evident from the bending lines 33', 34', the mold wall may be bent only over part of its length. In that case the mold wall is bent on one side of (above) its central axis 43, which extends transversely with respect to the strand travel or running direction 42, and is pivoted on the other side of (below) the central axis 43 at an angle with respect to the strand travel direction 42.

Additionally, or alternatively to the computation method of controlling the bending and the pivoting movement, the support and the cooling of the solidified shell or layer of the cast strand can be monitored and, if required, corrected by means of a series of measurements of the heat or thermal output of the mold wall taken in the strand travel direction 42.

A bending or, respectively, a change in the bending of a mold wall also can be applied to achieve an adjustment in the taper of the casting cavity or mold compartment in adaptation to changing casting parameters, such as casting rate or velocity, casting temperature, steel analysis, bath level in the mold, and so forth.

While there are shown and described present preferred embodiments of the invention, it is to be distinctly understood that the invention is not limited thereto, but may be otherwise variously embodied and practiced within the scope of the following claims. Accordingly,

What I claim is:

1. A method of cooling and supporting a steel strand in a plate mold of a continuous casting installation, in which said plate mold comprises wide side walls and at least one displaceable mold wall having a central axis, said method comprising the steps of:

moving said strand in a predetermined direction of travel;

changing the format of the cast strand by displacing the displaceable mold wall at a given rate of displacement;

calculating an instantaneous geometric shape of a moving solidified shell of the cast strand as a function of said rate of displacement of said mold wall and the velocity of movement of the moving solidified shell; and applying to said displaceable mold wall, during displacement thereof, a bend corresponding to the instantaneous geometric shape of the moving solidified shell of said strand and which shell is associated with said mold wall.

2. The method as defined in claim 1, further including the step of:

pivoting said mold wall while displacing the same.

3. The method as defined in claim 1, further including the step of:

displacing said mold wall in parallel with itself while displacing the same.

4. The method as defined in claim 1, further including the step of:

bending said mold wall to define circles of curvature having central axes which extend transversely with respect to said strand travel direction and essentially parallel to said mold wall.

5. The method as defined in claim 1, further including the step of:

bending said mold wall only over part of its length.

6. The method as defined in claim 5, further including the steps of:

bending said mold wall on one side of said central axis thereof which extends transversely with respect to said strand travel direction; and inclining said mold wall on the other side of said central axis thereof with respect to said strand travel direction.

7. The method as defined in claim 2, further including the steps of:

convexly bending said mold wall while pivoting the same such as to increase a casting taper of said plate mold.

8. The method as defined in claim 1, further including the step of:

pivoting said mold wall and at the same time displacing said mold wall as a unit.

9. A method of cooling and supporting a steel strand in a plate mold of a continuous casting installation, in which said plate mold comprises wide side walls and at least one displaceable mold wall having a central axis, said method comprising the steps of:

moving said strand in a predetermined direction of travel;

changing the format of the cast strand by displacing the displaceable mold wall at a given rate of displacement;

applying to said displaceable mold wall, during displacement thereof, a bend corresponding to the instantaneous geometric shape of the moving solidified shell of said strand and which shell is associated with said mold wall;

measuring the thermal output of said mold wall to obtain a sequence of thermal output measurements in said strand travel direction; and bending and displacing said mold wall as a function of said thermal output measurements.

10. A method of cooling and supporting a steel strand in a plate mold of a continuous casting installation, in which said plate mold comprises wide side walls and at least one displaceable mold wall having a central axis, said method comprising the steps of:

moving said strand in a predetermined direction of travel;

changing the format of the east strand by displacing the displaceable mold wall at a given rate of displacement;

applying to said displaceable mold wall, during displacement thereof, a bend corresponding to the instantaneous geometric shape of the moving solidified shell of said strand and which shell is associated with said mold wall;

pivoting said mold wall while displacing the same; and concavely bending said mold wall while pivoting the same such as to decrease a casting taper of said plate mold.

11. A plate mold for casting a steel strand in a continuous casting installation comprising:

wide side walls;

at least one displaceable mold wall cooperating with said wide side walls;

bending means operatively associated with said at least one displaceable mold wall for bending such mold wall along defined bending lines defining circles of curvature having central axes;

said central axes extending transversely with respect to a predetermined direction of travel of the cast strand and in parallel to said displaceable mold wall; and control means for controlling said bending means so as to apply to said displaceable mold wall, during displacement thereof, a bend corresponding to the instantaneous geometric shape of the moving solidified shell of the strand and which shell is associated with said displaceable mold wall.

12. The plate mold as defined in claim 11, wherein:

said displaceable mold wall comprises a flexible wall and a substantially rigid support plate cooperating with a support pin;

said bending means comprise displacement devices operatively connected to said rigid support plate; and said displacement devices being arranged on opposite sides of said support pin and being operable independently of each other.

13. The plate mold as defined in claim 12, wherein said support pin provides a hinge connection between said flexible wall and said rigid support plate.

14. The plate mold as defined in claim 12, wherein:

said flexible wall is composed of a copper plate and a flexible, non-metallic compound plate provided with cooling channels.

15. The plate mold as defined in claim 11, wherein:

said control means for controlling said bending means apply to said displaceable mold wall, during displacement thereof, a bend corresponding to the instantaneous geometric shape of the moving solidified shell of the strand and which bend is a function of the rate of displacement of the displaceable mold wall and the velocity of movement of the moving solidified shell of the strand.

* * * * *

UNITED STATES PATENT AND TRADEMARK OFFICE

CERTIFICATE OF CORRECTION

PATENT NO. : 4,505,321

DATED : March 19, 1985

INVENTOR(S) : JOSEF ZELLER

It is certified that error appears in the above—identified patent and that said Letters Patent is hereby corrected as shown below:

Column 6, line 49, please delete "east" and replace it with --cast--

Signed and Sealed this

*Thirtieth* Day of *July 1985*

[SEAL]

*Attest:*

DONALD J. QUIGG

*Attesting Officer*

*Acting Commissioner of Patents and Trademarks*